United States Patent [19]

Gudell

[11] 4,141,118

[45] Feb. 27, 1979

[54] HOOK AND RING CLASP

[75] Inventor: Gary Gudell, Commack, N.Y.

[73] Assignee: Jacoby-Bender, Inc., Woodside, N.Y.

[21] Appl. No.: 844,222

[22] Filed: Oct. 21, 1977

[51] Int. Cl.[2] ..... A44B 13/02

[52] U.S. Cl. ..... 24/201 HE; 24/236

[58] Field of Search ..... 24/201 HE, 75, 77 R, 24/201 R, 225, 236

[56] References Cited

U.S. PATENT DOCUMENTS

| | | | |
|---|---|---|---|
| 315,796 | 4/1885 | Keefe | 24/236 |
| 369,067 | 8/1887 | Macmillan | 24/225 |
| 705,620 | 7/1902 | Specat | 24/75 |
| 1,059,117 | 4/1913 | Chittenden | 24/236 |
| 1,549,261 | 8/1925 | Johnston | 24/201 R |
| 1,792,931 | 2/1931 | Roy | 24/231 |
| 1,821,839 | 9/1931 | Kerngood | 24/75 |
| 1,826,887 | 10/1931 | Kestenman | 24/232 |
| 1,892,350 | 12/1932 | Kestenman | 24/232 |
| 2,741,820 | 4/1956 | Legat | 24/236 |
| 3,562,766 | 2/1969 | Dye | 24/201 HE |
| 3,992,756 | 11/1976 | Stafstrom | 24/236 |
| 4,010,501 | 3/1977 | Cooke | 24/201 HE |
| 4,014,079 | 3/1977 | Camarda | 24/201 HE |
| 4,027,360 | 6/1977 | Moser | 24/236 |

FOREIGN PATENT DOCUMENTS

| | | | |
|---|---|---|---|
| 1908780 | 9/1970 | Fed. Rep. of Germany | 24/201 HE |
| 2250284 | 5/1975 | France | 24/201 HE |
| 582492 | 9/1972 | Switzerland | 24/201 R |
| 819799 | 9/1959 | United Kingdom | 24/201 R |

*Primary Examiner*—Bernard A. Gelak

*Attorney, Agent, or Firm*—James & Franklin

[57] ABSTRACT

A clasp for an article of jewelry comprises an elongated rigid ring element, which may be of generally rectangular configuration, and an elongated rigid hook element defining a generally U-shaped part-receiving chamber having its base at the front of the hook element. The ring element has four parts or legs defining together an aperture which may be generally rectangular in configuration, the front part being of reduced thickness with the top surface thereof disposed below the plane of the top surfaces of the side parts. The two elements, when assembled together to form the clasp, have the front part of the ring element disposed in the part-receiving chamber of the hook element, a major portion of the aperture visible from the top of the clasp, and the top surface of the front of the ring element in substantially the same plane as the top surface of the body portion of the hook element.

9 Claims, 20 Drawing Figures

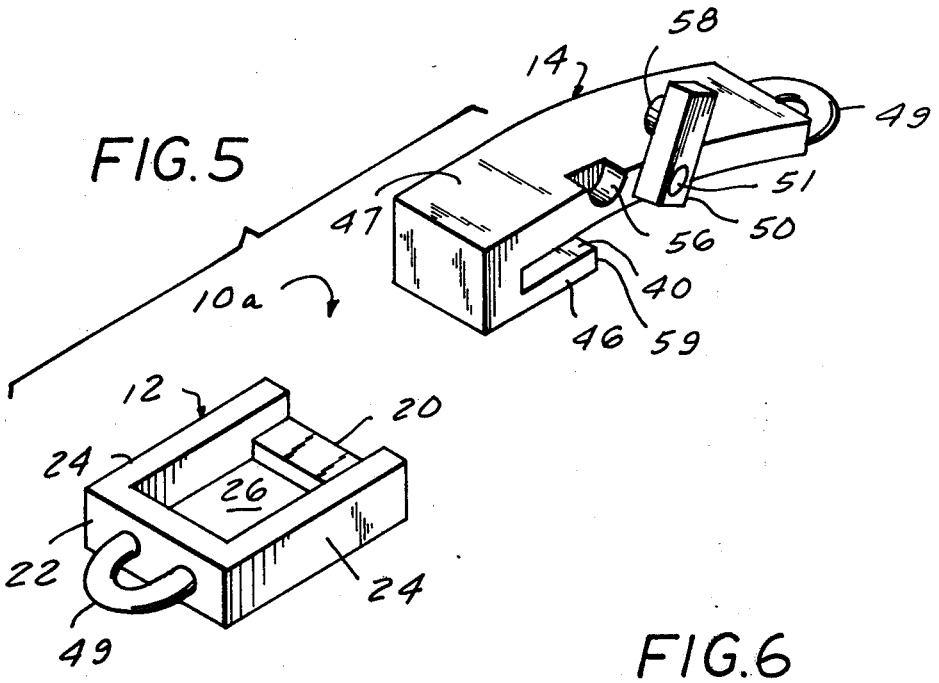
FIG. 5
FIG. 6
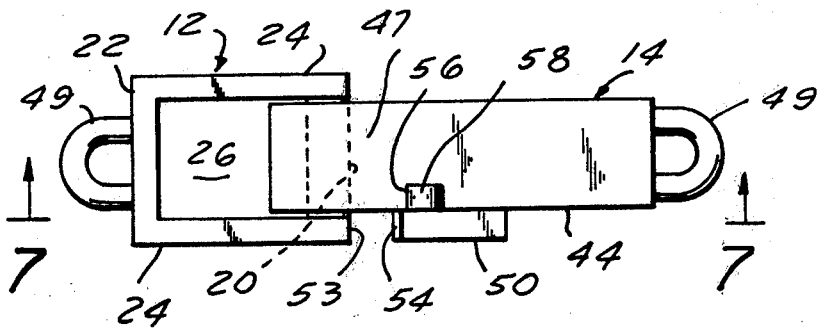
FIG. 7
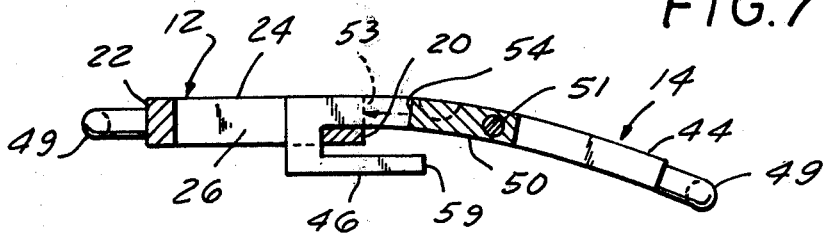
FIG. 8
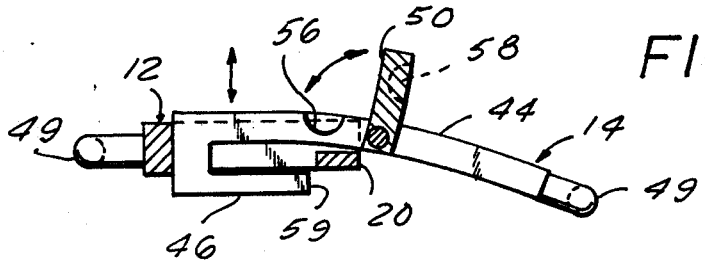

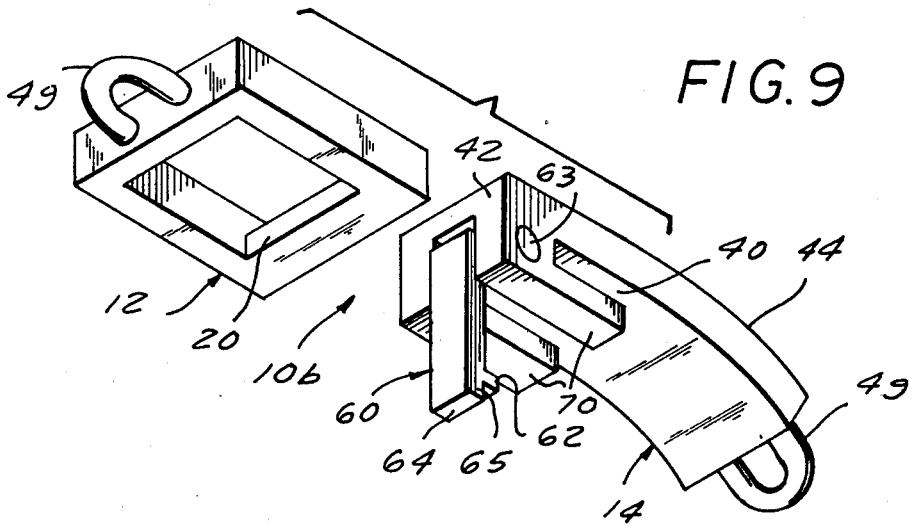
FIG. 9
FIG. 10
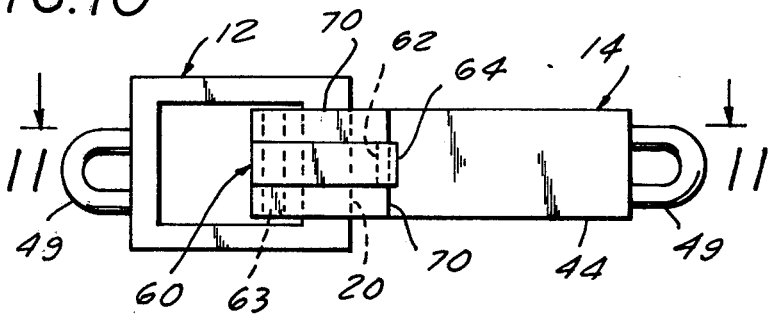
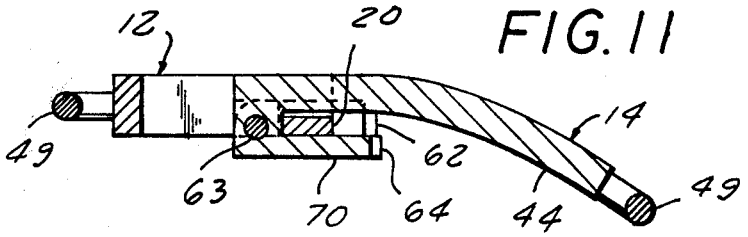
FIG. 11
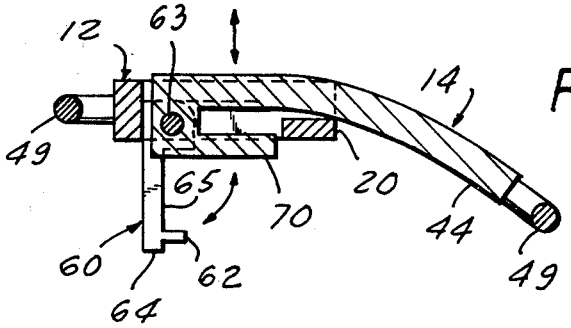
FIG. 12

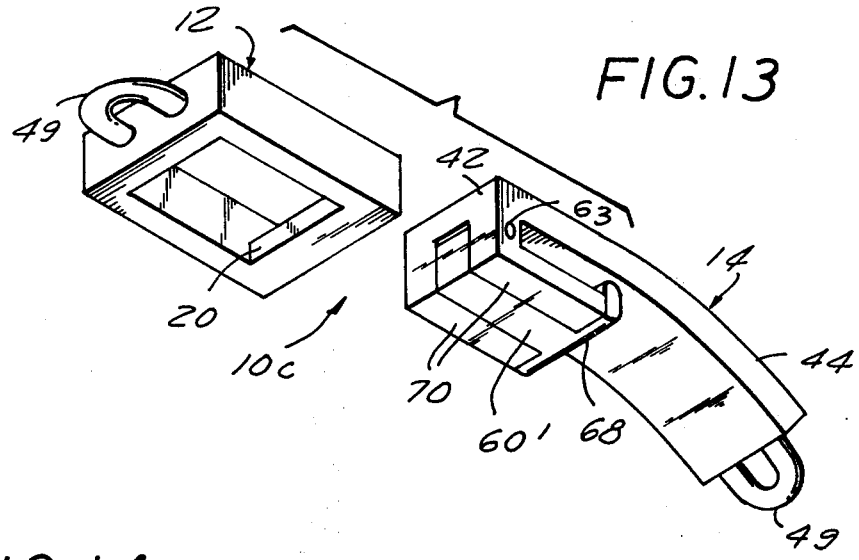
FIG. 13
FIG. 14
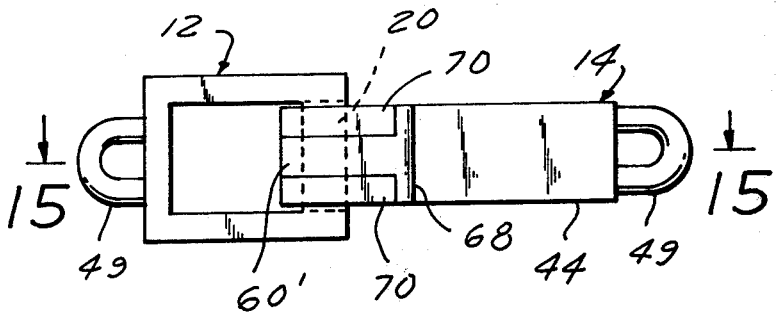
FIG. 15
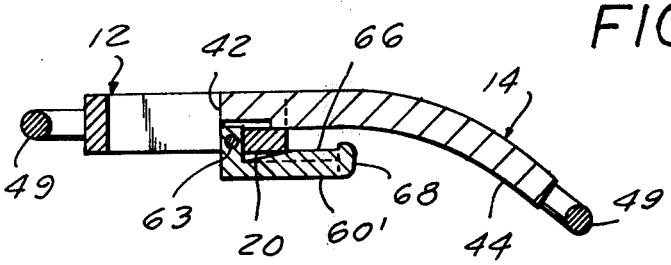
FIG. 16
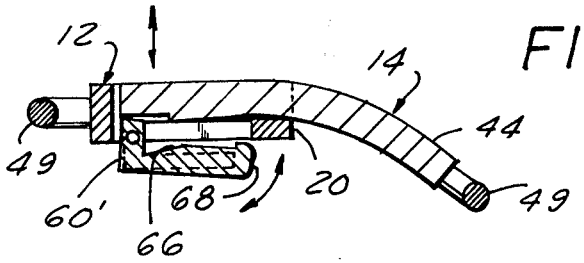

HOOK AND RING CLASP

BACKGROUND OF THE INVENTION

The present invention relates to a clasp for an article of jewelry, and more particularly to a ring and hook type clasp.

Ring and hook type clasps are well known in the art, examples thereof being found in U.S. Pat. Nos. 2,401,145 and 3,562,766. In many instances the functional structure of the clasp is so unsightly as to warrant its being hidden from view, for example, as in the buckle of U.S. Pat. No. 3,562,766. Such a structure obviously violates one of the basic tenets of the Bauhaus School that the appearance of an article should reflect its function. Accordingly, the need remains for a hook and ring type clasp in which the function of each element is manifest from the appearance of the clasp, and yet the clasp is attractive in appearance. To this end, it is desirable that a clasp have a major portion of the aperture of the ring element exposed at the top of the clasp, and in many instances it is also desirable that top surfaces of both the ring and hook elements be flush or substantially so.

As a practical matter it is also desirable for the clasp to be provided with a safety mechanism or catch, as shown in U.S. Pat. No. 2,401,145. However the known safety mechanisms are either unslightly, difficult to manipulate, or both. In addition, all known safety mechanisms require the user thereof to specifically disengage the safety mechanism as a separate and special part of the process of opening the clasp rather than having the safety mechanism disengage automatically as part of the same motion used to disengage the elements of the clasp.

Accordingly, it is an object of the present invention to provide a hook and ring clasp for jewelry in which a major portion of the aperture of the ring element is exposed to view, and in which desirably the top surfaces of the hook and ring elements lie, or appear to lie, in substantially the same plane.

Another object is to provide such a clasp having a safety mechanism which is easily manipulable.

A further object is to provide such a clasp having a safety mechanism which automatically disengages as part of the process of separating the hook and ring elements.

A final object is to provide such a clasp which is attractive, sturdy and compact, yet inexpensive to manufacture and easy to operate.

SUMMARY OF THE INVENTION

It has now been found that the above and related objects of the present invention are obtained in a clasp for an article of jewelry comprising an elongated rigid ring element, preferably of generally rectangular configuration, and an elongated rigid hook element defining a generally U-shaped leg-receiving chamber having its base at the front of the hook element. The ring element comprises a front leg, a back leg and a spaced pair of side legs connecting the front and back legs, the legs together defining an aperture which may be generally rectangular in configuration. The front leg is of reduced thickness with the top surface thereof being disposed below the plane of the top surfaces of the side legs.

The hook element has a body portion also preferably of generally rectangular outline, the front of the body portion doubling back and underneath to form a lip portion of appreciable length. The lip portion is configured and dimensioned to pass through the aperture and is spaced below the body portion sufficiently to receive therebetween the thickness of the front leg. When the hook and ring elements are assembled together to form a clasp, the front leg of the hook element is disposed in the leg-receiving chamber of the hook element. In the assembled position preferably a major portion of the aperture of the ring element is exposed at the top of the clasp, and the top surface of the front of the ring element is in substantially the same plane as the top surface of the front of the body portion.

Safety devices may be utilized in conjunction with such a clasp, and three such devices are herein illustrated. The first safety device here shown is adapted for use when the side legs of the ring element closely abut the side surfaces of the body portion when the hook and ring elements are assembled together, and comprises an elongated safety stop of appreciable width articulately secured to one side of the body portion. The stop is movable between a locking position wherein the stop is disposed substantially in the same plane as the front of the body portion to preclude separation of the hook and ring elements, and an unlocking position wherein the stop is disposed at an angle to the plane of the body portion to permit joinder and separation of the ring elements. The front portion of the stop in the locking position is preferably adjacent the back surface of the lip portion, and most preferably disposed at least partially over the lip portion. The top surface of the body portion of the hook element may also define a notch open at the top and at the one side thereof, the stop including a side flange extending into the notch when the stop is in the locking position so that the bottom surface of the notch limits the downward articulation of the stop relative to the body portion.

In the second and third safety devices are shown, the clasp includes an elongated catch member having a back end defining an upwardly extending lug and a front end articulately mounted on the front of the body portion. The catch member is movable between a locking position wherein the catch member lies substantially in the plane of the lip portion so that the lug operatively closes the back of the leg-receiving chamber to preclude withdrawal of the front leg therefrom, and an unlocking position wherein the catch member extends backwardly of and at least partially downwardly transverse to the plane of the lip portion so that the front leg may be inserted into and withdrawn from the leg-receiving chamber. Preferably the elongated center section of the lip portion is cut away and at least a portion of the catch member in its locking position is disposed intermediate the remaining sides of the lip portion. In the second safety device, the remaining sides of the lip portions snugly engage the sides of the catch member in its locking position to normally retain the catch member in its locking position. The catch member additionally includes tab means disposed on the back surface thereof to enable positive manual movement of the catch member from its locking position to its unlocking position, for example, by the application of finger pressure against the tab means. In the third safety device, the catch member in its locking position has a top surface sloping backwardly and upwardly higher than the lip portion so that in an asembled clasp positive manual movement of the front leg towards the back of the leg-receiving chamber (this being the same motion required to separate the hook and ring elements) moves the catch member to its unlocking position. Preferably when the catch is in its unlocking position the lug abuts the rear end of the lip portion to limit further movement of the catch member away from the lip portion.

In the fourth safety device here shown, the front end of the catch member is fixedly mounted on the front of the body portion, but the catch member is formed of a resilient material so that the detent-bearing rear end is movable between the aforementioned locking and unlocking positions. In other words, the upwardly extending detent is biased upwardly and movable between a locking position wherein the detent operatively closes the leg-receiving chamber and an unlocking position wherein the detent is depressed by the front leg to operatively open the back of the chamber and enable the front leg to be inserted into and withdrawn from the chamber. Preferably the detent or lug has an upper portion with upwardly and inwardly sloping sides so that positive manual movement of the front leg into or out of the leg-receiving chamber (this being the same motion required to separate or connect the hook and ring elements) moves the catch member temporarily to its unlocking position, the resiliency of the catch member automatically returning it to its locking position after the front leg passes over the detent. Preferably the elongated center section of the lip portion is of reduced thickness and provided with an aperture through and beyond which the lug or detent of the catch member normally extends to close the back of the leg-receiving chamber.

BRIEF DESCRIPTION OF THE DRAWING

FIG. 5 is an exploded isometric view of a clasp incorporating a first type of safety device;

FIG. 6 is a top plan view of the clasp of FIG. 5, showing the elements thereof in an assembled and locked position;

FIG. 7 is a side elevation view of the clasp, partially in cross-section, taken along the line 7—7 of FIG. 6;

FIG. 8 is a side elevation view, partially in cross-section, similar to FIG. 7, but showing the elements in an intermediate stage of assembly.

FIG. 9 is a exploded isometric view of a clasp incorporating a second type of safety device;

FIG. 10 is a bottom plan view of the clasp of FIG. 9, showing the elements thereof in an assembled and locked position;

FIG. 11 is a side elevation view of the clasp, partially in cross-section, taken along the line 11—11 of FIG. 10;

FIG. 12, is a side elevation view, partially in cross-section, similar to FIG. 11, but showing the elements in an intermediate stage of assembly;

FIG. 13 is an exploded isometric view of a clasp incorporating a third type of safety device;

FIG. 14 is a bottom plan view of the clasp of FIG. 13, showing the elements thereof in an assembled and locked position;

FIG. 15 is a side elevation view of the clasp, partially in cross-section, taken along the line 15—15 of FIG. 14;

FIG. 16 is a side elevation view, partially in cross-section, similar to FIG. 15, but showing the elements in an intermediate stage of assembly;

DETAILED DESCRIPTION OF THE PREFERRED EMBODIMENTS

Figure 1:
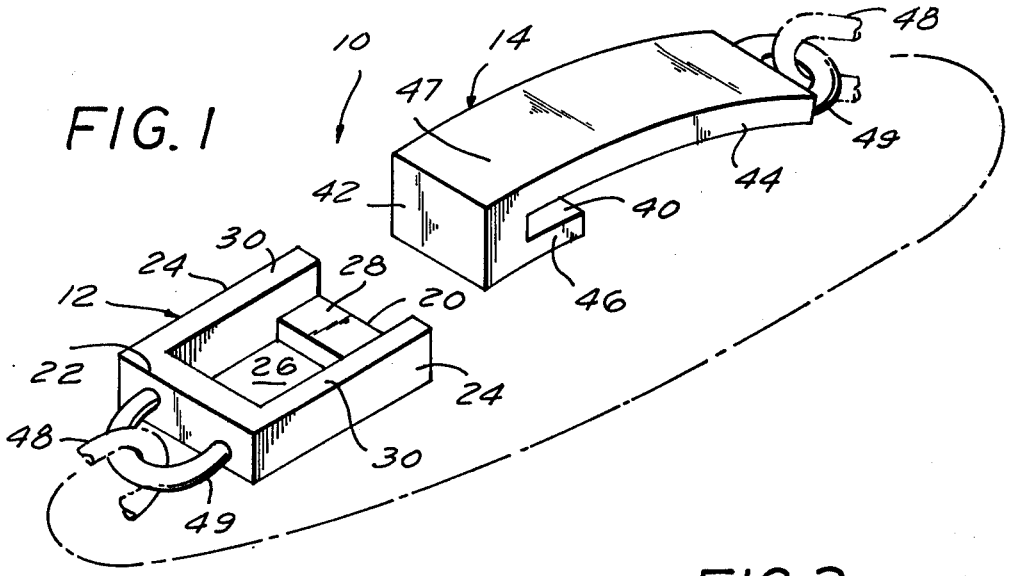
FIG. 1 is an exploded isometric view of a basic clasp according to the present invention, with fragmentary portions of the end links of a piece of jewelry affixed thereto being shown in phantom line.

Referring now to the drawing, and in particular to FIGS. 1–4 thereof, therein illustrated is a clasp, generally designated 10, for an article of jewelry. Generally clasp 10 comprises an elongated ring element generally designated 12 and an elongated hook element generally designated 14. Except as hereinafter noted, both elements 12 and 14 may be formed of any rigid material conventionally used in clasps, for example a metal such as gold alloy.

More particularly, the ring element 12, which is preferably of generally rectangular configuration, comprises a front leg 20, a back leg 22 and a spaced pair of side legs 24 connecting the front and back legs 20,22. The legs 20,22 and 24 together define an aperture 26 of appreciable size and preferably of generally rectangular configuration. The front leg 20 is of reduced thickness relative to the side legs 24 and has its top surface 28 disposed below the plane of the top surfaces 30 of the side legs for reasons which will become apparent hereinafter.

The hook element 14 defines a generally U-shaped chamber 40 having the base of the "U" disposed at the front 42 of the hook element 14. The hook element 14 is comprised of an elongated body portion 44 of generally rectangular outline, the front 42 of the body portion 44 doubling back and underneath the main part thereof to form a lip portion 46 of appreciable length. The lip portion 46 and the front 42 are configured and dimensioned to pass through the aperture 26. The top surface of the lip portion 46 is spaced below the bottom surface of the body portion 44 sufficiently to enable receipt therebetween of the thickness of the front leg 20 of the ring element 12. Thus it will be appreciated that the leg-receiving chamber 40 is formed by the top surface of the lip portion 46 at the bottom, the front bottom surface of the body portion 44 at the top, and the back surface of the front 42 (which defines the base of the chamber 40).

While the front segment of the body portion 44 (that is, the part of the body portion 44 vertically aligned with the lip portion 46) is generally substantially planar, the back segment of the body portion 44 may be curved somewhat to match the contour of the part of the body on which it will rest.

Figure 2:
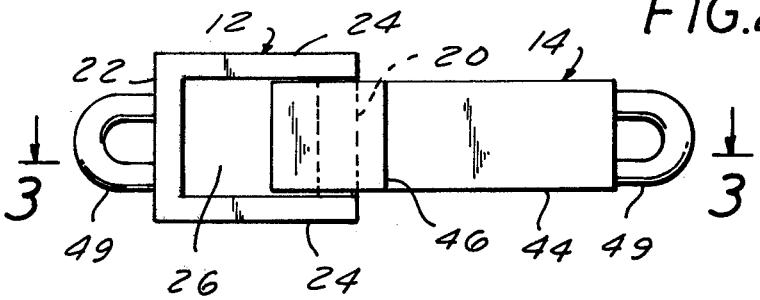
FIG. 2 is a bottom plan view of the clasp of FIG. 1, showing the elements thereof in an assembled position.
Figure 3:
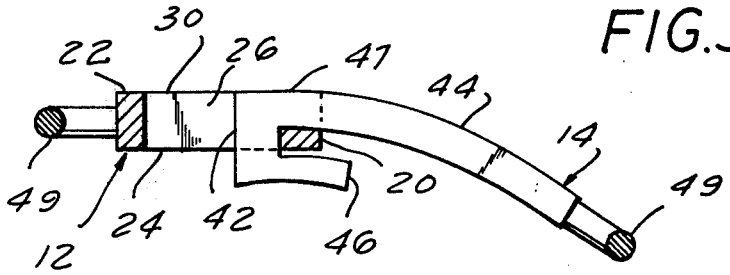
FIG. 3 is a side elevation view of the clasp taken along the line 3—3 of FIG. 2.
Figure 4:
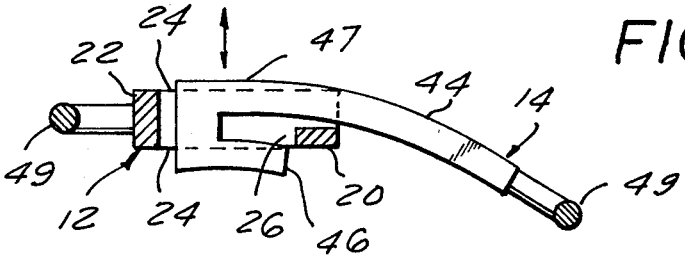
FIG. 4 is side elevation view, similar to FIG. 3, but showing the elements in an intermediate stage of assembly.
Figure 17:
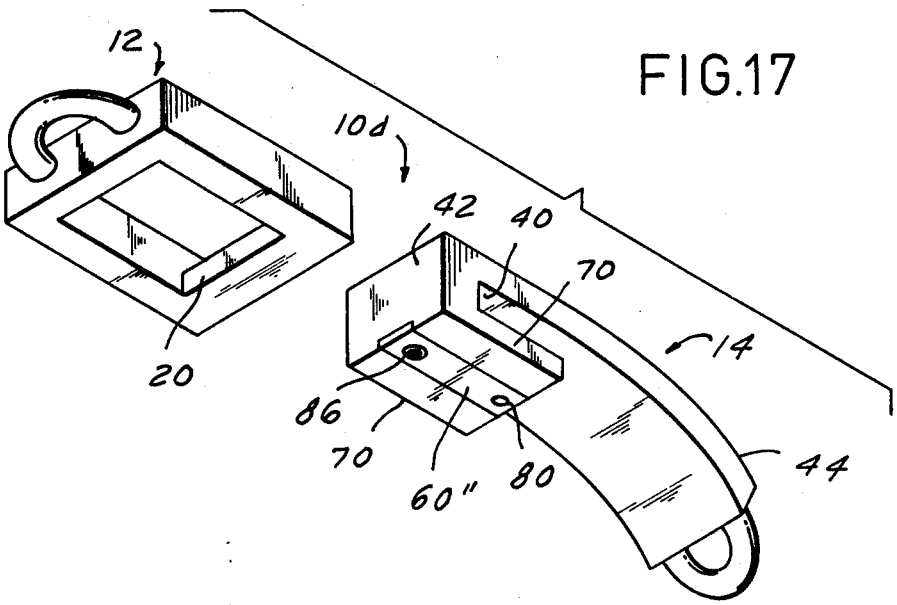
FIG. 17 is an exploded isometric view of a clasp incorporating a fourth type of safety device.
Figure 18:
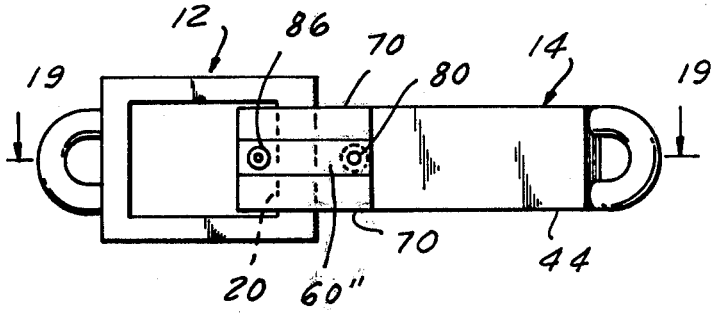
FIG. 18 is a bottom plan view of the clasp of FIG. 17, showing the elements thereof in an assembled and locked position.
Figure 19:
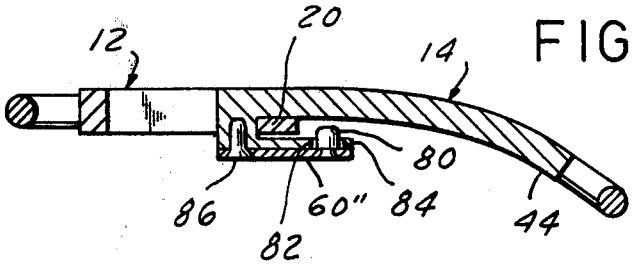
FIG. 19 is a side elevation view of the clasp, partially in cross-section, taken along the line 19—19 of FIG. 18.
Figure 20:
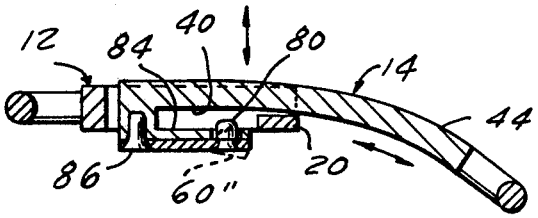
FIG. 20 is a side elevation view, partially in cross-section, similar to FIG. 19, but showing the elements in an intermediate stage of assembly.

The elements 12,14 of the clasp 10 are easily assembled together by vertically aligning the lip portion 46 above the aperture 26, lowering the hook element 14 (as shown in FIG. 4) until the front leg 20 is in the same plane as the open mouth of the chamber 40, and then moving the elements 12,14 in opposite directions in a horizontal plane. This results in the front leg 20 of the ring element 12 entering the leg receiving chamber 40 of the hook element 14 (as shown in FIGS. 2–3), thereby exposing a major portion of the aperture 26 to view at the top of the clasp. Assuming that the front leg 20 is pressed against the front 42 of the hook element 14, all of the aperture 26 is exposed saved for that portion occupied by the front 42. Preferably the front leg 20 has a thickness reduced, relative to the side legs 24, by the thickness of the body portion 44, so that when the front leg 20 is in the leg-receiving chamber 40, the top surface 47 of the front segment of the body portion 44 lies in substantially the same plane as the top surface 30 of the front of the side legs 24 of the ring element 12.

The basic clasp 10 described above may be utilized in any situation where end links 48 of the article of jewelry to which the link ends 49 of the clasp are attached will exert sufficient horizontal force in opposite directions on the ends 49 to insure that the front leg 20 is maintained in the chamber 40, that is, forwardly of the rear end of the lip portion 46. The elements 12,14 may be easily disengaged from one another simply by moving them towards each other until the front leg 20 traverses the back end of the lip portion 46 (see FIG. 4) at which point the elements 12,14 may be vertically displaced, and thus separated.

Referring now to FIGS. 5–8, therein illustrated is a first preferred embodiment **10*a* of the basic clasp incorporating a first type of safety device precluding an accidental separation of the elements 12,14 and enabling use of the clasp 10*a* even in connection with pieces of jewelry which do not exert the oppositely directed horizontal forces on the element ends 49 required for the basic clasp 10. The safety mechanism comprises an elongated stop 50 of appreciable width which is articulately secured at 51 to one side of the body portion 44, for example, by a pivot shaft. The stop 50 is movable between a locking position wherein the stop 50 is disposed substantially in the same plane as the front of the body portion (see FIGS. 6–7) and an open or unlocking position wherein the stop is disposed at an angle to the plane of the body portion (see FIGS. 5 and 8). In the locking position the stop 50 precludes separation of the hook and ring elements 12,14 because it effectively increases the width of the body portion 44 so that the front leg 20 cannot be withdrawn from the leg-receiving chamber 40 due to the abutment of the front 53 of a side leg 24 of the ring element 12 against the front 54 of the stop 50. On the other hand, when the stop 50 is in the open or raised position, the increased effective width of the body portion 44 occurs only at a point sufficiently rearwardly of the lip portion 46 so that it does not interfere with the front leg 20 being inserted into or removed from the leg-receiving chamber 40**.

It will be recognized that this type of safety mechanism is useful only when the side legs 24 of the ring element 12 closely abut the side surfaces of the body portion 44 when the elements 12,14 are assembled together; that is, the separation between the side legs 24 must be less than the combined width of the body portion 44 and the stop 50.

While a frictional engagement between the side of the stop 50 and the adjacent side of the body portion 44 may be utilized to maintain the stop 50 in its locking position, it is greatly preferred that a more positive position-limiting device be provided. Accordingly, the top surface of the body portion 44 defines a notch 56 which is open at the top and side thereof adjacent stop 50, and the stop 50 includes a side flange 58 extending into the notch 56 when the stop 50 is in the locking position. The bottom surface of the notch 56 limits the downward pivoting of the stop 50 relative to the body portion 44 to maintain the stop 50 in its locking position. Preferably the front 54 of the stop 50 in its locking position is adjacent the back surface 59 of the lip portion 46, and most preferably disposed at least partially over the lip portion 46 as shown in FIG. 7.

The elements 12,14 of the clasp 10 are assembled together conventionally with the stop 50 in the open or unlocking position, after which the stop 50 is manually moved downwardly to its closed or locking position (counterclockwise as shown in FIG. 5). In order to separate the elements 12,14, a finger may be used to move the free end of the stop 50 upwardly (clockwise as shown in FIG. 5) until the stop 50 assumes its open position, thereby enabling a conventional disassembly of the elements 12,14.

It will be appreciated that the angle formed by the stop 50 and the body portion 44 in the open position may be less than a right angle so long as the stop in its open position does not interfere with the removal of the front leg 20 from the chamber 40. The appropriate placement of the pivotal axis 51 of the stop 50 will, of course, depend upon the length of the stop 50.

Referring now to FIGS. 9–12, therein illustrated is a second preferred embodiment **10*b* of the basic clasp incorporating a second type of safety device. The basic clasp has been modified to the extent that an elongated center section of the lip portion 46 and a center portion of the front 42 of the hook element 14 have been cut away. The safety device here comprises an elongated, generally planar catch member, generally designated 60, having a back end defining an upwardly extending lug 62 and a front end articulately mounted on the front 42 of the hook element 14, for example, by a shaft 63 rotatably mounted in the front 42. The catch member 60 is pivotable between a locking position wherein the catch member 60 is substantially in the plane of the lip portion 46 (see FIGS. 10–11) and an open or unlocking position wherein the catch member 60 extends at least partially downwardly transverse to the plane of the lip portion 46 (see FIGS. 9 and 12). In the locking position the lug 62 operatively closes the back of the leg-receiving chamber 40 to preclude withdrawal of the front leg 20 therefrom (that is, the lug 62 extends upwardly to a level such that the separation, if any, between the top of the lug 62 and the bottom of the body portion 44 is insufficient to permit passage of the front leg 20 therebetween). In the open or unlocking position the top of the lug 62 is sufficiently spaced from the bottom of the body portion 44 to enable the front leg 20 to be inserted and withdrawn from the leg-receiving chamber 40**.

Preferably the sides 65 of the catch member 60 are snugly engaged by the adjacent sides of the lip portion segments 70 when the catch member 60 is in the locking position, so that the frictional forces between the lip portion segments 70 and catch member 60 normally retain the catch member 60 in the locking position. To facilitate movement of the catch member 60 from its locking position to its unlocking position, the rear end of the catch member 60 is preferably provided with a backwardly extending tab 64 so that the user's finger may grasp the tab 64 and by means thereof open the catch member 60 by the exertion of sufficient positive manual effort to overcome the frictional forces maintaining the catch member 60 in its locking position.

Referring now to FIGS. 9–12, therein illustrated is a third preferred embodiment 10*c* of the basic clasp incorporating a third type of safety device. In this embodiment the catch member 60' is basically similar to catch 60 of the second preferred embodiment 10*b*, but has neither lug 62 nor tab 64. Rather catch member 60' is provided with a top surface 66 which, in the locking position, slopes backwardly and upwardly higher than the lip portion 46 by a distance sufficient to operatively close the back of the leg-receiving chamber 40. The slope of the top surface 66 is preferably relatively smooth so that, as the front leg 20 is moved toward the back of the leg-receiving chamber 40 by a positive manual force such as would be used as part of the clasp opening process even in the absence of catch member 60', the front leg 20 cams top surface 66 and forces the catch member 60' to move from its locking position to its open or unlocking position.

If desired, the catch member 60' may also be provided with a tab 64 (now shown) to facilitate opening of the catch member 60' in the event it becomes closed at a time when the front leg 20 is not within the leg-receiving chamber 40. Preferably, however, the rear end of the catch member 60' defines a transverse member or bar 68 which extends outwardly to either side of the main portion of the catch member 60' and has a front surface configured and dimensioned to abut the rear end of the adjacent lip portion segments 70 when the catch member 60' has been moved out of its locking position and into its open position just sufficiently to permit withdrawal of leg 20 from the leg-receiving chamber 40. It has been found that the extra width of the bar 68 (relative to the back end of the catch member 60') enables easy opening of the catch member 60' by the user's finger even in the absence of the tab 64 as well as serving as a limit to the open position of the catch member 60'.

It will be appreciated that the catch member 60' may be maintained in its closed position through a frictional engagement of the sides of the catch member 60' with the adjacent sides of segments 70 of the lip portion 46, through a frictional engagement of the front surface of the bar 68 with the back surface of the segments 70, or through a combination thereof.

Referring now to FIGS. 17–20, therein illustrated is a fourth preferred embodiment 10*d* of the basic clasp incorporating a fourth type of safety device. In this embodiment the catch member 60'' is basically similar to catch member 60' of the third preferred embodiment 10*c*, but is formed of a resilient material rather than a rigid material as in the case of the other embodiments. Catch member 60'' is provided with an upwardly extending detent 80 which, in the locking position extends through an aperture 82 in a lip portion 84 of reduced thickness and therebeyond higher than the adjacent lip portion segments 70 by a distance sufficient to operatively close the back of the leg-receiving chamber 40 and preclude accidental withdrawal of front leg 20 therefrom. The catch member 60'' has its front end fixedly secured to the bottom of the front 42 by a pin 86, with the detent 80 being disposed adjacent the rear of the catch member 60''. Preferably the detent 80 slopes upwardly and inwardly, at least adjacent the upper portion thereof. Thus when the front leg 20 is moved either toward the back of the leg-receiving chamber 40 by a positive manual force, such as would be used as part of the clasp opening process even in the absence of catch member 60'', or toward the front of the leg-receiving chamber 40 by a positive manual force, such as would be used as part of the clasp closing process even in the absence of catch member 60'', the front leg 20 cams detent 80 and forces the catch member 60'' to move from its normal unstressed locking position (with the catch member 60'' disposed substantially in the plane of the lip portion) to its stressed open or unlocking position (with the catch member 60'' extending at least partially downwardly transversely to the plane of the lip portion, as illustrated in phantom line in FIG. 20). As soon as the front leg 20 passes the detent 80, the resiliency of the catch member 60'' returns the detent 80 to its original position (that is, the catch member 60'' returns to its locking position).

It will be appreciated that in the fourth preferred embodiment 10*d*, the catch member 60'' is automatically moved to its open or unlocking position as part of the normal clasp opening process, and in this regard is similar to the third preferred embodiment 10*c*; however, in the fourth preferred embodiment 10*d* the catch member 60'' is also moved to its open or unlocking position as part of the clasp closing process. Accordingly, there is no need for any counterpart of a tap 64 or bar 68 to facilitate opening of the catch member in the event that it becomes closed at a time when the front leg 20 is not within the leg-receiving chamber 40. Furthermore, there is no need for any frictional engagement between the sides of the catch member 60'' with the adjacent lip portion segments 70 to maintain the catch member 60'' in its closed position, as this is accomplished automatically by means of the resilient nature of the catch member 60''. It will further be appreciated that the height of the detent 80 (i.e., the distance by which it extends upwardly beyond segments 70) acts as a limit on the degree to which the catch member 60'' will be automatically opened during the clasp opening or closing process, and no further limit is required as the catch member 60'' need never be directly acted upon by a finger as part of the clasp opening or closing process.

To summarize, the present invention provides a basic clasp that is not only functional but aesthetic in appearance. The clasp is sturdy and compact, yet inexpensive to manufacture and easy to operate. Various safety mechanisms may be provided in conjunction therewith to prevent accidental opening thereof, at least one of the safety mechanisms offering automatic opening thereof as part of the clasp opening process and a limit on the degree to which the safety mechanism may be opened, and another of the safety mechanisms offering automatic opening and closing thereof as part of the clasp opening and closing process.

Now that the preferred embodiments of the present invention have been shown and described in detail, various improvements and modifications thereon will become readily apparent to those skilled in the art. Accordingly, the spirit and scope of the present invention is to be limited only by the appended claims, and not by the foregoing disclosure.

I claim:

1. A clasp for an article of jewelry comprising:

A. an elongated rigid ring element comprising a front part, a back part, and a spaced pair of side parts connecting said front and back parts, said parts together defining an aperture, and said front part being of reduced thickness relative to said side parts with the top surface thereof disposed below the plane of the top surfaces of said side parts;

B. an elongated rigid hook element having a body portion the front of which doubles back and underneath to form a lip portion of appreciable length, and a generally U-shaped part-receiving chamber having its base at the front of said hook element, said lip portion being configured and dimensioned to pass through said aperture and spaced below said body portion sufficiently to receive therebetween the thickness of said front part of said ring element; said hook and ring elements when assembled together disposed to form said clasp having said front part of said ring element disposed in said chamber of said hook element;

C. an elongated catch member having a front end fixedly mounted on the front of said hook element and a back end defining an upwardly extending detent, said detent being biased upwardly and movable between a locking position wherein said detent operatively closes the back of said chamber to preclude withdrawal of said front part therefrom and an unlocking position wherein said detent is depressed by said front part to operatively open the back of said chamber and enable said front part to be inserted into and withdrawn from said chamber, said detent being configured and dimensioned to be automatically moved from said locking position into said unlocking position by the movement of said front part thereover during separation of said hook and ring elements.

2. The clasp of claim 1 wherein the combined thickness of said front part and said body portion, absent said lip portion, are substantially equal to the thickness of said side parts.

3. The clasp of claim 1 wherein said ring element and said aperture are of generally rectangular configuration.

4. The clasp of claim 1 wherein, when said hook and ring elements are assembled together to form said clasp, the top surface of the front of said ring element lies in substantially the same plane as the top surface of the front of said body portion.

5. The clasp of claim 4 wherein, when said hook and ring elements are assembled together to form said clasp, a major portion of said aperture is exposed at the top of said clasp.

6. The clasp of claim 1 wherein, when said hook and ring elements are assembled together to form said clasp, a major portion of said aperture is exposed at the top of said clasp.

7. The clasp of claim 1 wherein an elongated center section of the bottom of said lip portion is cut-away and the remaining upper center section of said lip portion defines an aperture therethrough, said detent passing through said aperture and normally therebeyond to close said chamber.

8. The clasp of claim 1 wherein said detent has an upper portion with upwardly and inwardly sloping sides.

9. The clasp of claim 1, wherein said catch member is formed of a resilient material enabling movement between said locking and said unlocking positions, and wherein in said locking position said catch member is disposed substantially in the plane of said lip portion and in said unlocking position said catch member is stressed to extend at least partially downwardly transverse to the plane of said lip portion.

* * * * *